US005911931A

United States Patent [19]

Fukuda et al.

[11] Patent Number: 5,911,931

[45] Date of Patent: Jun. 15, 1999

[54] RESIN FORMING METHOD

[75] Inventors: Zenpei Fukuda; Masashi Okamoto, both of Otake, Japan

[73] Assignee: Mitsubishi Rayon Co., Ltd., Tokyo, Japan

[21] Appl. No.: 08/950,066

[22] Filed: Oct. 14, 1997

Related U.S. Application Data

[62] Division of application No. 08/843,585, Apr. 21, 1997.

[30] Foreign Application Priority Data

Apr. 24, 1996 [JP] Japan ..... 8-102273

[51] Int. Cl.[6] ..... D01D 1/10; D01D 4/00; D06M 15/643

[52] U.S. Cl. ..... 264/130; 264/169; 264/211.14

[58] Field of Search ..... 264/130, 169, 264/176.1, 211.14

[56] References Cited

U.S. PATENT DOCUMENTS 4,034,034 7/1977 Eberius et al. ..... 264/169 X
4,203,939 5/1980 Drachenberg et al. .
4,301,101 11/1981 Bachmann et al. ..... 264/130
4,388,057 6/1983 Bachmann et al. .

FOREIGN PATENT DOCUMENTS 43-11823 5/1968 Japan .
44-2492 2/1969 Japan .
52-34016 3/1977 Japan .
6-29506 7/1992 Japan .

*Primary Examiner*—Leo B. Tentoni
*Attorney, Agent, or Firm*—Pillsbury Madison & Sutro LLP

[57] ABSTRACT

A method for forming a resin including the steps of forming a resin by using a resin forming nozzle device while supplying thereto a surface lubricant for mold release, having a viscosity of 0.1 to 1,000 cP during use and a surface tension of 40 dyn/cm or less at a temperature of 25° C., wherein the resin forming nozzle device includes the surface lubricant being continuously introduced to a nozzle face having the discharge openings of resin extrusion orifices, the device further including a feed section for supplying a surface lubricant from the outside, and one or more grooves formed on said nozzle face in positions adjacent to the discharge openings of the nozzle face so that the grooves have a width of 10 to 3,000 μm and a depth of 10 μm or greater and at least one end thereof communicates with the surface lubricant feed section.

4 Claims, 3 Drawing Sheets

RESIN FORMING METHOD

This is a divisional of application Ser. No. 08/843,585, filed on Apr. 21, 1997.

BACKGROUND OF THE INVENTION

1. Field of the Invention

This invention relates to a resin forming nozzle device in which a surface lubricant (e.g., silicone oil) having mold release properties is continuously supplied to the resin forming nozzle face, and to a resin forming method using the same device.

2. Description of the Prior Art

When a synthetic fiber, as an example of formed resin products, is spun, oligomer of the resin or products resulting from the gradual degradation of a surface lubricant applied to the spinneret face may accumulate on the spinneret face from which resin filaments emerge, especially around the spinning orifices thereof. This may cause the spun filaments to be bent or broken. When the spun filaments are bent or broken, the spinning of the synthetic fiber must be discontinued to correct (or clean) the spinneret face. This requires much labor and also causes a significant reduction in production efficiency.

In order to solve the above-described problem, attempts have been made to modify the material of the spinneret and/or the longitudinal sectional shape of the spinning orifices or to introduce a surface lubricant continuously to the spinneret face. For example, Japanese Patent Publication No. 11823/'68 discloses a spinning method in which the spinneret face is inclined and a surface lubricant is continuously introduced to the spinneret face. In this method, however, the lengths of the spinning orifices vary along the circumference, which tend to induce a kneeling phenomenon in which the spun filaments bend at the outlets of the spinning orifices. If the structure of the spinneret is modified so as to cause the surface lubricant to flow down toward the center of the spinneret, various problems may arise, for example, in that the discharge pipe provided for the purpose of withdrawing the surface lubricant may come into contact with the spun filaments. Accordingly, it is difficult to use this spinneret for practical purposes.

Japanese Patent Publication No. 2492/'69 discloses a spinning method in which the spinneret face is provided with a porous part made of a porous metal or the like and a surface lubricant is introduced into the spinning orifices by infiltrating the surface lubricant into the porous part. However, this method tends to cause an uneven distribution of the amount of surface lubricant infiltrated. Especially in the neighborhood of the site at which the surface lubricant is introduced, the surface lubricant drips down and thereby exerts an adverse influence on the spinning. Moreover, although the porous part is made so as to form part of the spinning orifices and give a divergent shape to the outlets thereof, the amount of the surface lubricant may vary along the circumference of the spinning orifices to induce a kneeling phenomenon Furthermore, this method has the disadvantage that the presence of irregularities in the spinneret face makes its cleaning difficult and the porous metal may be clogged with the spinning solution, gas or cleaning agent. Thus, this method fails to bring about the desired result and cannot readily be put to practical use.

Japanese Patent Laid-Open No. 143719/'78 discloses a spinning method in which a surface lubricant is introduced through an annular distributor disposed on the peripheral region of the spinneret. This method enables the surface lubricant to be more or less effectively introduced to the aforesaid peripheral region However, it is difficult to introduce the surface lubricant to the central region of the spinneret. Thus, this method still fails to introduce the surface lubricant uniformly to the whole spinneret.

Japanese Patent Laid-Open No. 158311/'80 discloses a spinning method in which a surface lubricant is introduced by means of a distributing plate having grooves which is disposed on the peripheral region of the spinneret or on the whole spinneret face except the spinning orifices. In this method, flow channels are formed by pressing the groove-bearing side of the distributing plate against the spinneret face. However, this method requires a spinneret device having a very complicated structure. Moreover, when the distributing plate having grooves is disposed on the whole spinneret face except the spinning orifices, it becomes difficult to correct (or clean) the spinneret face.

In order to supply the surface lubricant to the spinneret, a feeding method utilizing the head of a surface lubricant tank and a feeding method using a metering pump are commonly employed. However, when the former is employed to supply the surface lubricant, the feed rate may vary because of difficulty in keeping the head constant. On the other hand, when the latter is employed, the feed rate can be stabilized. However, this method has the disadvantage of requiring a considerable equipment cost.

SUMMARY OF THE INVENTION

As described above, the conventional methods have the disadvantage that they require a complicated spinneret structure and, moreover, the surface lubricant may be nonuniformly introduced to the nozzle face to cause an uneven distribution thereof or may drip down to exert an adverse influence on the spinning. Accordingly, an object of the present invention is to provide a resin forming nozzle device which can introduce a surface lubricant continuously to the whole nozzle face and uniformly to the center of the nozzle, can prevent the surface lubricant from dripping down, has a simple structure, and permits the surface lubricant to be stably supplied, as well as a resin forming method using this nozzle device.

Thus, the present invention relates to a resin forming nozzle device wherein a surface lubricant having mold release properties is continuously introduced to a nozzle face having the discharge openings of resin extrusion orifices. The resin forming nozzle device comprises a feed section for supplying the surface lubricant from the outside, and one or more grooves formed in positions adjacent to the discharge openings of the nozzle face so that they have a width of 10 to 3,000 $\mu$m and a depth of 10 $\mu$m or greater and at least one end thereof communicates with the surface lubricant feed section.

The present invention also relates to a resin forming method which comprises forming a resin by using the aforesaid resin forming nozzle device while supplying thereto a surface lubricant having a viscosity of 0.1 to 1,000 cP during use and a surface tension of 40 dyn/cm or less.

DETAILED DESCRIPTION OF THE INVENTION AND PREFERRED EMBODIMENTS

Figure 1:
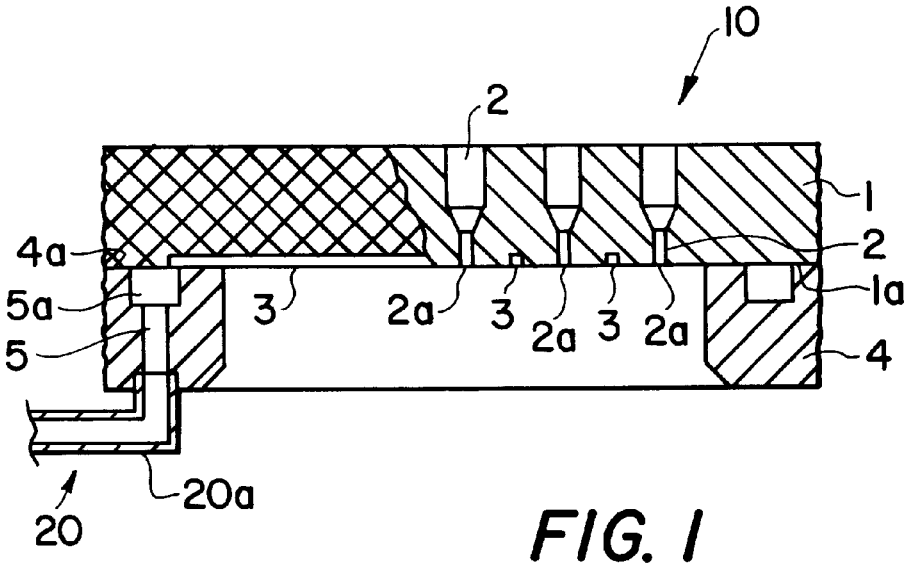
FIG. 1 is a schematic sectional view of a spinneret device to which the present invention is applied.

In the present invention, the dimensions of the grooves are determined with consideration for the ease of cleaning and the developability of capillarity. The grooves preferably have a width of 10 to 3,000 $\mu$m, more preferably 100 to 500 $\mu$m, and a depth of 10 $\mu$m or greater, more preferably 50 to 500 $\mu$m. If the width of the grooves is 10 $\mu$m or greater, no clogging will occur. On the other hand, if the width of the grooves is 3,000 $\mu$m or less, the surface lubricant can be easily supplied to the center of the nozzle face owing to capillarity. Moreover, if the depth of the grooves is 10 $\mu$m or greater, the surface lubricant can also be easily supplied to the center of the nozzle face owing to capillarity.

The surface lubricant feed section serves as an interface for supplying the externally fed surface lubricant steadily to the grooves. No particular limitation is placed on the structure thereof, provided that a sufficient flow rate of the surface lubricant to supply it uniformly to the grooves can be secured.

In the method of the present invention, the surface lubricant preferably has a viscosity of 0.1 to 1,000 cP, more preferably 0.1 to 500 cP, and a surface tension of 40 dyn/cm or less, more preferably 30 dyn/cm or less. As used herein, the surface tension is a value measured at a temperature of 25° C. Although the surface lubricant of the present invention is used at high temperatures (e.g., in the vicinity of 290° C. for polyethylene terephthalate) the present inventors have found that, if its surface tension at 25° C. is 40 dyn/cm or less, it can easily spread even during use at high temperatures to extend over the whole nozzle face and form a thin oil film. That is, a surface lubricant having a surface tension of 40 dyn/cm or less at 25° C. can easily spread even at high temperatures and form a thin film on the nozzle face. As used herein, the viscosity of the surface lubricant is a value measured at the temperature employed for its use. If its viscosity is in the range of 0.1 to 1,000 cP, the surface lubricant scarcely drips down and, moreover, can easily spread over the whole nozzle face.

It is preferable that the aforesaid resin forming nozzle device further comprises a surface lubricant receiver disposed at the bottom thereof. In this case, even if the surface lubricant drips down, it exerts no adverse influence on the resin emerging from the extrusion orifices because the surface lubricant trickles down the inner wall of the receiver.

Furthermore, it is preferable that the aforesaid surface lubricant feed section is connected to an external surface lubricant supply source and the surface lubricant supply source has a dripping device. In this case, slight amounts of the surface lubricants can be stably supplied.

It is also preferable that the aforesaid nozzle face has a surface roughness (i.e., variation in height) characterized by a maximum height ($R_{max}$) of 0.4 $\mu$m or greater. As used herein, the maximum height ($R_{max}$) is defined as the value obtained by sampling a portion having a sampling length of 0.25 mm (a sampled portion) from the profile curve, sandwiching the sampled portion between two straight lines parallel to the average line of the sampled portion, and measuring the distance between these two straight lines along the ordinate axis of the profile curve (JIS B0601).

The aforesaid resin forming nozzle device can be used as a spinneret device and, in particular, as a spinneret device for melt spinning.

Organic polysiloxanes are suitable for use as the surface lubricant. Among others, silicone oils of the following formula are especially preferred.

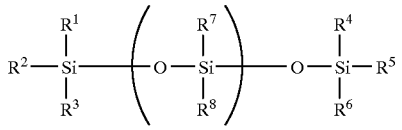

where $R^1$ to $R^8$ each represents methyl, phenyl or hydrogen.

Specific examples of the silicone oils are dimethyl silicone and methylphenyl silicone.

Several embodiments of the present invention will be specifically described hereinbelow with reference to the accompanying drawings.

First of all, an embodiment in which the present invention is applied to a spinneret device is described.

FIG. 1 is a sectional view of the whole of a spinneret device 10. This spinneret device 10 consists of a spinneret body 1 having a plurality of spinning orifices (or resin extrusion orifices) 2 formed in the central part thereof and a surface lubricant introducing member 4 disposed on the peripheral region of the spinneret face 1*a* of the spinneret body 1. The aforesaid spinneret body 1 and surface lubricant introducing member 4 are stacked and held together so that the spinneret face 1*a* is in close contact with the introducing member face 4*a*. The spinneret face 1*a* has the discharge openings 2*a* of the spinning orifices 2. The spinneret face 1*a* also has one or more grooves 3 which are formed in the spinneret face 1*a* so that they are adjacent to a plurality of discharge openings 2*a* and do not communicate with the discharge openings 2*a*. These grooves 3, in cooperation with the introducing member face 4*a*, define flow channels for introducing a surface lubricant. The surface lubricant introducing member 4 has a surface lubricant feed hole 5 which extends upward from the bottom and communicates with the introducing member face 4*a*, and the upper part of this feed hole 5 is formed into a pool 5*a* for holding the supplied surface lubricant, thus constituting a surface lubricant feed section in accordance with the present invention. To the feed hole 5 is connected a feed pipe 20*a* for supplying a surface lubricant from an externally installed surface lubricant feeding device 20 serving as a surface lubricant supply source.

No particular limitation is placed on the material and shape of the aforesaid spinneret body 1. However, the surface roughness of the spinneret face 1*a* must be properly determined because it greatly affects the spread of the surface lubricant. Specifically, the surface roughness should preferably be determined so that the maximum height ($R_{max}$) is 0.4 $\mu$m or greater, whereby the surface lubricant can spread at a sufficiently high rate, As used herein, the maximum height ($R_{max}$) is defined as the value obtained by sampling a portion having a sampling length of 0.25 mm (a sampled portion) from the profile curve, sandwiching the sampled portion between two straight lines parallel to the average line of the sampled portion, and measuring the distance between these two straight lines along the ordinate axis of the profile curve (according to JIS B0601). That is, this means the degree of surface roughness in which, when a length of 0.25 mm is sampled from the surface of the spinneret face, the difference between the highest peak and the lowest valley is 0.4 μm or greater.

From the viewpoint of spinning stability, the edge surfaces of the discharge openings 2*a* in the spinneret face 1*a* need to be evenly finished along the circumference thereof, and a higher degree of roughness is preferred in order to improve the penetrability of the surface lubricant. However, if the degree of roughness is unnecessarily high, the edge surfaces of the discharge openings 2*a* may suffer a failure in shape. Accordingly, the upper limit of the maximum height ($R_{max}$) in the edge surfaces of the discharge openings 2*a* should preferably be 2 μm or less as measured in a sampled portion having a length of 0.8 mm. Usually, the whole spinneret face 1*a* is machined in an evenly finished state. However, it is important that the peripheral regions of the discharge openings 2*a* are formed so as to have a surface roughness within the above-defined limits, and the other regions may be in any desired state.

No particular limitation is placed on the cross-sectional shape of the discharge openings 2*a*, and they may have a circular or special cross section.

With regard to the shape of the spinning orifices, Japanese Patent Laid-Open No. 25906/'94 has proposed that the diameter of the spinning orifices 2 should be gradually altered toward the discharge openings 2*a* in order to inhibit the production of degradation products. However, this cannot be expected to have a significant effect because such degradation products are not produced only in the spinning orifices 2.

Figure 2A:
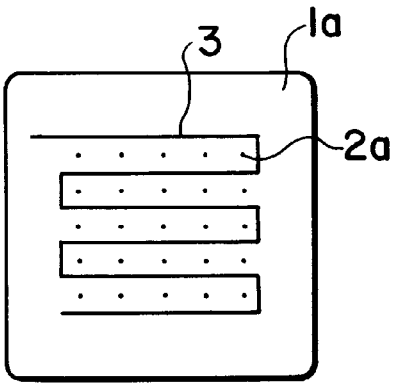
FIG. 2(*a*) to 2(*c*) are top views of the spinneret face in the spinneret device of FIG. 1, showing various relationships between the discharge openings and the groove(s)
Figure 2B:
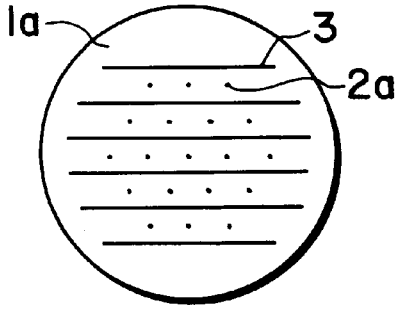
Figure 2C:
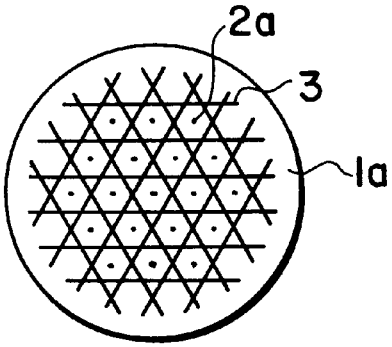

No particular limitation is placed on the cross-sectional shape and machining accuracy of the groove(s) 3. However, in view of the ease of machining, it is preferable that they have a triangular, rectangular, U-shaped or dovetail cross section. As an example of the configuration of the groove(s) 3, a single groove 3 may be formed in such a way that it runs parallel and reciprocatingly between horizontal rows of the discharge openings 2*a* as illustrated in FIG. 2(*a*). Alternatively, a plurality of parallel grooves 3 may be formed between horizontal rows of the discharge openings 2*a* as illustrated in FIG. 2(*b*), or three groups of parallel grooves 3 may be formed in such a way that they run between horizontal and oblique rows of the discharge openings 2*a* and they cross each other, as illustrated in FIG. 2(*c*). In view of the supply-demand balance of the surface lubricant, it is preferable that one or more discharge openings 2*a* are present on either side of the groove(s) 3.

Owing to the supply pressure and capillarity of the surface lubricant, the surface lubricant flows along the groove(s) 3 toward the center of the spinneret face 1*a* and thereby fills the groove(s) 3 completely. At the same time, the surface lubricant spreads from the groove(s) 3 over the spinneret face 1*a* and then flows to the discharge openings 2*a*. Since the amount of surface lubricant introduced into the discharge openings 2*a* is governed by the surface tension and viscosity of the surface lubricant, it is stably introduced without any excess. The depth of the groove(s) 3 may be increased toward the center of the spinneret face 1*a* and the introducing member face 4*a*, so that the surface lubricant may flow more easily toward the center. No particular limitation is placed on the method for machining the groove(s) 3, and any suitable method may be chosen according to the shape of the groove(s) 3.

The surface lubricant introducing member 4 may be provided with one or more surface lubricant feed holes 5 and a plurality of pools 5*a*. However, the number of the pools 5*a* needs not correspond to that of the surface lubricant feed holes 5. The pools 5*a* are required especially where the surface lubricant is supplied from one surface lubricant feed hole 5 to a plurality of grooves 3, and they serve effectively to cause the surface lubricant to flow uniformly into the plurality of grooves 3. Consequently, where a single groove 3 is provided as illustrated in FIG. 2 (a), the surface lubricant feed hole 5 may communicate directly with the groove 3, instead of forming the pools 5*a*. The surface lubricant supplied through the surface lubricant feed hole(s) 5 first fills the pools 5*a* and then flows into the plurality of grooves 3.

As described above, the surface lubricant flows from the grooves 3 to the spinneret face 1*a* and the introducing member face 4*a*. If the resulting pressure loss is smaller than the pressure loss in the pools 5*a*, the surface lubricant undesirably tends to undergo a short pass in the neighborhood of the surface lubricant feed hole 5. However, this is not a serious problem, provided that the surface lubricant is introduced into all of the grooves 3.

Figure 3:
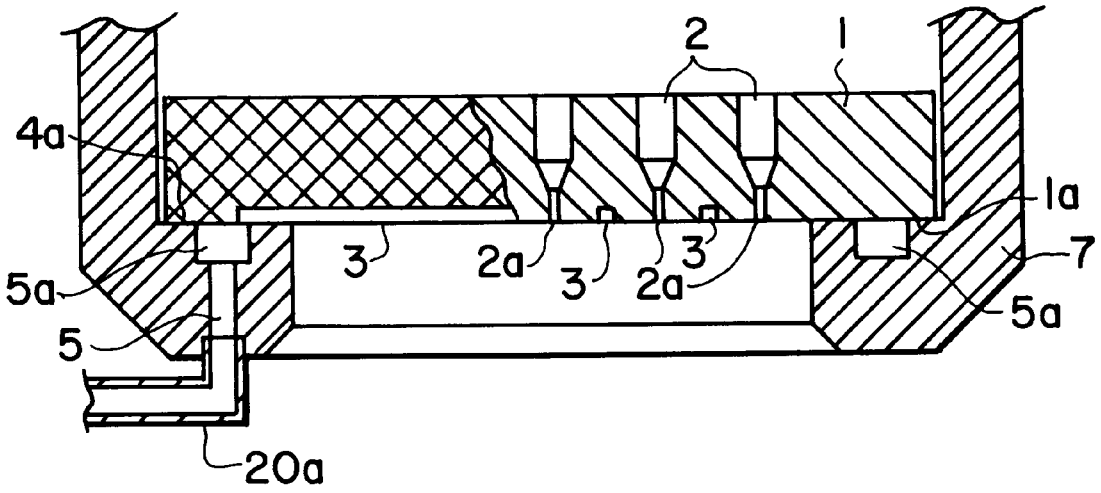
FIG. 3 is a schematic sectional view of a spinneret device in accordance with another embodiment of the present invention.
Figure 4:
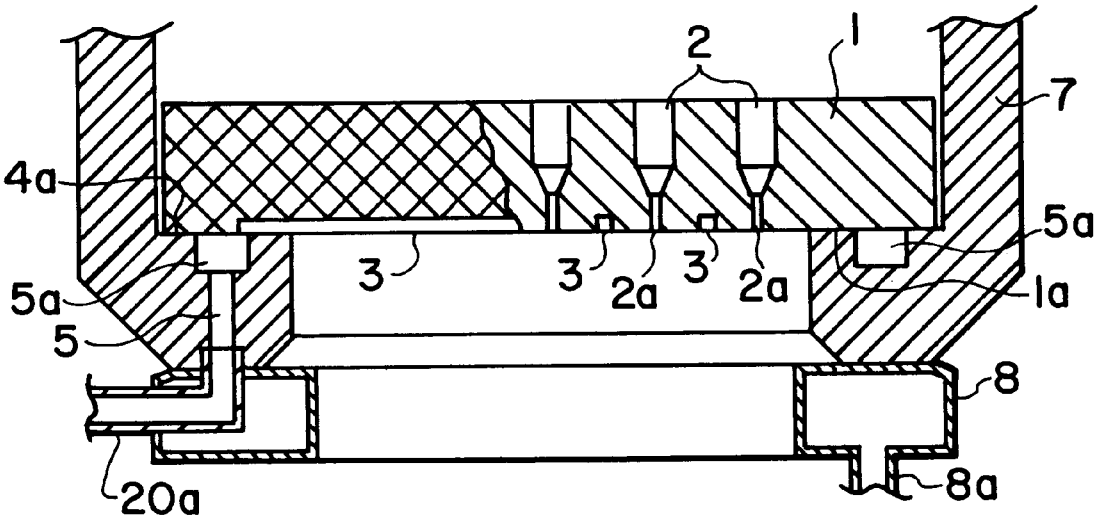
FIG. 4 is a schematic sectional view of a spinneret device provided with a surface lubricant receiver.

In the spinneret device illustrated in FIG. 1, the surface lubricant introducing member 4 is formed separately from the spinneret body 1. However, the surface lubricant introducing member 4 may be formed integrally with a holder 7 for holding the spinneret body 1, as illustrated in FIG. 3.

Moreover, in the spinneret device illustrated in FIG. 1, the surface lubricant is supplied from the bottom of the spinneret device 10. However, the feed section of the present invention is not limited to this construction For example, the surface lubricant may be supplied from the top of the spinneret device 10 by providing the spinneret body 1 with a hole for supplying the surface lubricant.

The surface lubricant is introduced into the discharge openings 2*a*. If the surface lubricant is introduced in excess, it will flow down the inner wall of the surface lubricant introducing member 4. As a countermeasure therefor, it is effective to use a receiver 8 which is disposed at the bottom of the surface lubricant introducing member 4 and provided with a surface lubricant outlet 8*a*.

Where the aforesaid receiver is used, the spinneret device of the present invention requires two piping systems including the feed pipe for supplying the surface lubricant and a discharge pipe for withdrawing the surface lubricant. While the feed pipe can be connected to the top of the spinneret body 1, the discharge pipe needs to be connected to the bottom of the spinneret body 1 because the discharge hole generally extends downward.

No particular limitation is placed on the method for connecting this discharge pipe. For example, the receiver provided with a discharge pipe may be fixed to the spinneret body. However, in view of the ease of connection, it is preferable to fix the receiver to the spinneret body in advance and connect the discharge pipe to the receiver afterwards.

Moreover, in this case, the receiver should preferably have a flat bottom surface so that the spinneret body having the receiver fixed thereto can be stably placed on the floor surface.

In order to connect the feed pipe to the surface lubricant introducing member or the discharge pipe to the receiver, there may be used a conventional swage lock (manufactured by Osaka Valve Fitting Co., Ltd.) or the like. However, this method comprises connecting and fixing the pipe by screwing. Although satisfactory sealing properties and heat resistance can be achieved, this method is disadvantageous in that its workability is poor and, owing to the large size of the joint, the resin may adhere thereto at the beginning of spinning.

Accordingly, as described below, it is preferable to connect and fix the feed pipe to the surface lubricant introducing member, or the discharge pipe to the receiver, with the aid of a sealing member alone.

Figure 5:
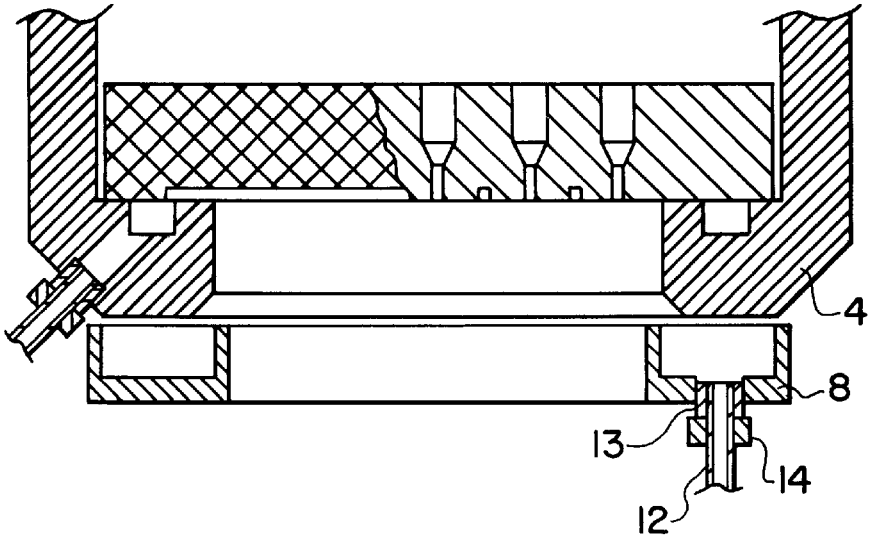
FIG. 5 is a schematic sectional view of a spinneret device in which a feed pipe and a discharge pipe are connected and fixed to a receiver with the aid of a sealing member.

In FIG. 5, a receiver 8 and a discharge pipe 12 are illustrated. Moreover, a cylindrical or conical sealing member 13 and a stopper 14 are also illustrated. The receiver 8 is provided with a hole having a size determined with consideration for the size of the sealing member 13 and the securement of sealing properties. In view of its handleability, the discharge pipe 12 should preferably have an outer diameter of 1 to 10 mm. The sealing member 13 functions to prevent oil leakage and connect the discharge pipe to the receiver. The sealing member 13 is preferably made of a material which can withstand its service temperature and has a proper degree of flexibility. Among others, Viton (fluorinated elastomer; trademark of E. I. Du Pont de Nemours & Co.), silicones, expanded silicones and teflon are preferred, and non-resinous materials such as cork may also be used. The shape of the sealing member 13 should be conical when the receiver 8 has a straight hole, but may be cylindrical when the hole of the receiver 8 is tapered. The sealing member 13 needs to have an opening formed at the center so that the discharge pipe may pass therethrough. The stopper 14, which may be used according to the need, serves to prevent the sealing member from slipping out of place or falling off. The receiver 8 illustrated in this figure is formed so as to have a flat bottom surface or so as to be supported at three or more points, so that it can be stably placed on the floor surface before a discharge pipe 12 is connected thereto. The sealing member 13 may be fastened to the receiver 8 in advance or may be fastened to the discharge pipe 12. Where the sealing member 13 is fastened to the discharge pipe 12, the discharge pipe 12 can be easily connected and sealed simply by inserting the sealing member 13 into the hole of the receiver 8.

Figure 6:
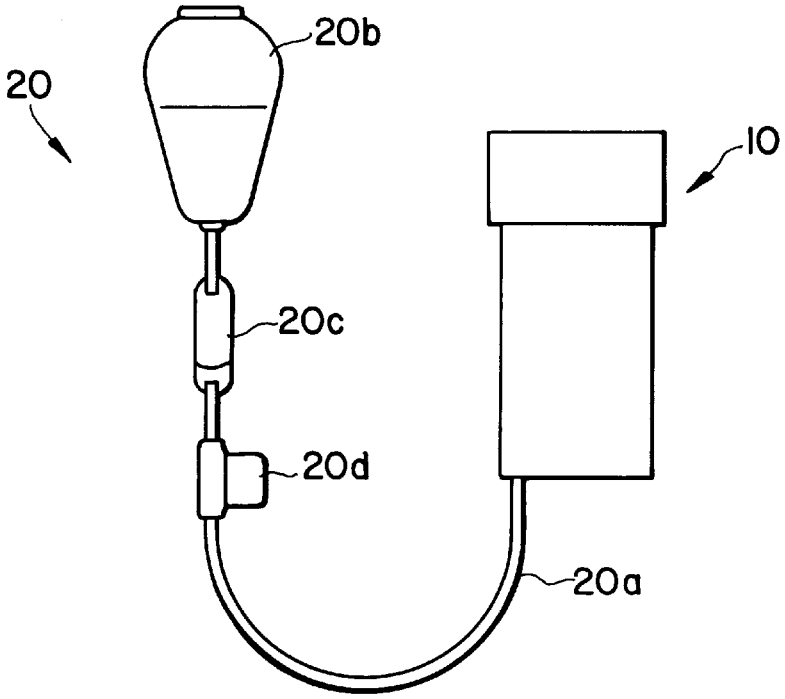
FIG. 6 is a schematic view showing the overall construction of a surface lubricant feeding device.

As the aforesaid surface lubricant feeding device 20, there may be employed any of various conventional means such as the method utilizing the head of a surface lubricant tank, the opening or closing of a valve, and a metering pump. However, it is preferable to use a surface lubricant feeding device 20 comprising a surface lubricant tank 20*b*, a dripping device 20*c* and a valve 20*d* as illustrated in FIG. 6. This surface lubricant feeding device 20 can supply slight amounts of the surface lubricant continuously and stably, by regulating the opening of the valve 20*d*. Moreover, this surface lubricant feeding device 20 is inexpensive and very easy to operate.

The resin forming nozzle device of the present invention can be used as a spinneret device for various synthetic fibers, and the spinning method is not limited to melt spinning or solution spinning. The resin forming nozzle device of the present invention can also be used as an extrusion nozzle for the formation of various resin products such as sheets and films. Accordingly, no particular limitation is placed on the material of the nozzle, and there may be used any of the materials which can be made into nozzles, such as stainless steel (e.g., SUS 304), ceramics (e.g., zirconia) and noble metals (e.g., platinum).

Especially where the resin forming nozzle device of the present invention is used for melt spinning purposes, the preset temperature is expected to be in the range of 150 to 350° C. Accordingly, the surface lubricant is also required to have heat resistance. To this end, an organic polysiloxane can be used as the surface lubricant. In particular, it is preferable to use a silicone oil of the following formula.

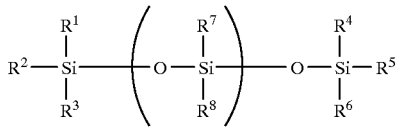

where $R^1$ to $R^8$ each represents methyl, phenyl or hydrogen.

Among such silicone oils, dimethyl silicone and methylphenyl silicone are especially preferred. Such silicone oils having a heat stabilizer added thereto can be effectively used. In view of its storage and its flowability on the nozzle face, it is preferable that the surface lubricant is liquid at room temperature.

The present invention is not limited to the use of a silicone as the surface lubricant, but there may be used any surface lubricant that render the resin releasable from the nozzle and exerts no adverse influence on the formed resin. Where it is desired to modify the surfaces of the formed resin at the same time, it is also possible to use a soluble surface lubricant. Moreover, it maybe effective to preheat the surface lubricant in the surface lubricant introducing member 4 or the feed pipe 20*a* so that the spinneret body 1 will not be cooled by the surface lubricant.

Examples 1 to 3

Using several spinneret devices 10 as illustrated in FIG. 1, polyethylene terephthalate was spun to form 70-denier filaments. The width and depth of the grooves 3 and the type of the surface lubricant are shown in Table 1. The viscosities shown in Table 1 are values measured at 290° C. and the surface tensions shown therein are values measured at 25° C.

TABLE 1

| | Depth of grooves (μm) | Width of grooves (μm) | Surface lubricant | Viscosity (cP) | Surface tension (dyn/cm) |
|---|---|---|---|---|---|
| Example 1 | 400 | 500 | Dimethyl silicone | 1 | 17 |
| Example 2 | 200 | 50 | Dimethyl silicone | 30 | 20 |
| Example 3 | 100 | 100 | Methylphenyl silicone | 100 | 20 |

The frequencies of filament breakage observed in Examples 1–3 in which the polymer was spun by the resin forming method of the present invention using the respective spinneret devices 10 are shown in Table 2. For purposes of comparison, the results obtained in Comparative Examples 1 and 2 are also shown in Table 2. In Table 2, the apparent viscosities (in poises) of the polymer used are values measured at the respective spinning temperatures and expressed in $10^3$ $sec^{-1}$.

TABLE 2

| | Apparent viscosity of polymer used | Spinning temperature (° C.) | Spinning speed (m/min) | Frequency of filament breakage (times/t) |
|---|---|---|---|---|
| Example 1 | 2,000 | 290 | 3,000 | 0 |
| Example 2 | 1,500 | 295 | 5,000 | 0 |
| Example 3 | 1,100 | 300 | 2,000 | 1 |
| Comparative Example 1 | 1,500 | 295 | 5,000 | 5 |
| Comparative Example 2 | 1,100 | 300 | 2,000 | 8 |

Example 4

A silicone rubber stopper was used as a sealing member as illustrated in FIG. 5. This made it possible to connect the discharge pipe very easily and secure sealing properties. In this example, an intermediate part of the discharge pipe was otherwise fixed in order to prevent the discharge pipe from falling off together with the silicone rubber stopper.

As described above, the resin forming nozzle device of the present invention not only has a simple structure, but also permits a surface lubricant to be continuously and uniformly introduced to the whole nozzle face. Moreover, the surface lubricant does not drip down and, even if the nozzle face is not corrected (or cleaned), neither oligomers of the resin nor degradation products of the surface lubricant accumulate on the nozzle face. Consequently, stable spinning can be performed for a long period of time without causing breakage of the filaments.

Furthermore, in a preferred embodiment of the present invention, the discharge pipe can be easily connected to achieve an improvement in workability. In addition, space can be saved around the discharge pipe and the problem of resin adhesion at the beginning of spinning can be solved.

We claim:

1. A resin forming method comprising the steps of:

forming a resin by using a resin forming nozzle device while supplying thereto a surface lubricant for mold release, having a viscosity of 0.1 to 1,000 cP during use and of 40 dyn/cm or less at a temperature of 25° C., a surface tension, wherein said resin forming nozzle device comprises said surface lubricant being continuously introduced to a nozzle face having the discharge openings of resin extrusion orifices, said device further comprising:

a feed section for supplying a surface lubricant from the outside; and one or more grooves formed on said nozzle face in positions adjacent to said discharge openings of said nozzle face so that said grooves have a width of 10 to 3,000 $\mu$m and a depth of 10 $\mu$m or greater and at least one end thereof communicates with said surface lubricant feed section.

2. The resin forming method as claimed in claim 1 wherein the surface lubricant is an organic polysiloxane.

3. The resin forming method as claimed in claim 2 wherein the organic polysiloxane is a silicone oil of the formula

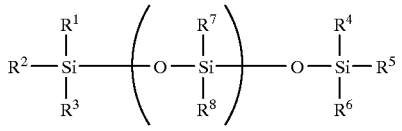

where $R^1$ to $R^8$ each represents methyl, phenyl or hydrogen.

4. The resin forming method as claimed in claim 3 wherein the silicone oil is dimethyl silicone or methylphenyl silicone.

* * * * *